US008729999B2

(12) United States Patent
Hahn et al.

(10) Patent No.: US 8,729,999 B2
(45) Date of Patent: May 20, 2014

(54) MULTI-LAYERED CHIP ELECTRONIC COMPONENT

(71) Applicant: Samsung Electro-Mechanics Co., Ltd., Gyunggi-do (KR)

(72) Inventors: Jin Woo Hahn, Gyunggi-do (KR); Sung Yong An, Gyunggi-do (KR); Soo Hwan Son, Gyunggi-do (KR); Ic Seob Kim, Gyunggi-do (KR); Byeong Cheol Moon, Gyunggi-do (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 0 days.

(21) Appl. No.: 13/660,543

(22) Filed: Oct. 25, 2012

(65) Prior Publication Data

US 2013/0335185 A1 Dec. 19, 2013

(30) Foreign Application Priority Data

Jun. 14, 2012 (KR) ..... 10-2012-0063828

(51) Int. Cl.
*H01F 5/00* (2006.01)
*H01F 27/24* (2006.01)
*H01F 27/30* (2006.01)

(52) U.S. Cl.
USPC ..... 336/200; 336/233; 336/234; 336/206

(58) Field of Classification Search
USPC ..... 336/200, 83, 233, 234, 223, 206, 207
See application file for complete search history.

(56) References Cited

U.S. PATENT DOCUMENTS

| | | | | |
|---|---|---|---|---|
| 7,304,557 | B2 * | 12/2007 | Tsuzuki et al. | 336/200 |
| 7,446,638 | B2 * | 11/2008 | Nogi | 336/200 |
| 8,587,400 | B2 * | 11/2013 | Nakajima et al. | 336/200 |
| 2002/0140539 | A1 * | 10/2002 | Takashima et al. | 336/200 |
| 2007/0188288 | A1 * | 8/2007 | Ishii | 336/200 |
| 2009/0051476 | A1 * | 2/2009 | Tada et al. | 336/105 |
| 2013/0038419 | A1 * | 2/2013 | Kobayashi et al. | 336/200 |

FOREIGN PATENT DOCUMENTS

| | | | |
|---|---|---|---|
| JP | 2002-093623 | A | 3/2002 |
| JP | 2002-299123 | A | 10/2002 |
| JP | 2002299123 | * | 10/2002 |
| JP | 2004-342963 | A | 12/2004 |
| JP | 2006-216916 | A | 8/2006 |
| JP | 2008-130736 | A | 6/2008 |

* cited by examiner

*Primary Examiner* — Alexander Talpalatski
*Assistant Examiner* — Kazi Hossain
(74) *Attorney, Agent, or Firm* — McDermott Will & Emery LLP

(57) ABSTRACT

There is provided a multi-layered chip electronic component, including: a multi-layered body including a plurality of first magnetic layers on which conductive patterns are formed; and second magnetic layers interposed between the first magnetic layers within the multi-layered body, wherein the conductive patterns are electrically connected to form coil patterns in a stacking direction, and when a thickness of the second magnetic layer is defined as Ts and a thickness of the conductive pattern is defined as Te, $0.1 \leq Ts:Te \leq 0.3$ is satisfied.

11 Claims, 7 Drawing Sheets

MULTI-LAYERED CHIP ELECTRONIC COMPONENT

CROSS-REFERENCE TO RELATED APPLICATIONS

This application claims the priority of Korean Patent Application No. 10-2012-0063828 filed on Jun. 14, 2012, in the Korean Intellectual Property Office, the disclosure of which is incorporated herein by reference.

BACKGROUND OF THE INVENTION

1. Field of the Invention

The present invention relates to a multi-layered chip electronic component.

2. Description of the Related Art

Among multi-layered chip electronic components, an inductor, in addition to a resistor and a capacitor, is a representative passive element capable of removing noise through being included in an electronic circuit.

A multi-layered chip type inductor may be manufactured by printing conductive patterns so as to form a coil within a magnetic substance or a dielectric substance and by stacking the resultant layers. The multi-layered chip inductor has a structure in which a plurality of magnetic layers on which conductive patterns are formed are stacked. Internal conductive patterns within the multi-layered chip inductor are sequentially connected by via electrodes formed in each magnetic layer so as to allow a coil structure to be formed within a chip to implement targeted inductance and impedance characteristics.

Recently, as the multi-layered chip inductor has been miniaturized and thinned, the multi-layered chip inductor has a defect of reduced inductance due to DC bias. In addition, a set in which the miniaturized multi-layered chip inductor is adopted is driven at high current and therefore, the multi-layered chip inductor is also required to be able to cope with high current.

Therefore, a need exists for development of a multi-layered chip inductor capable of coping with high levels of current while allowing DC bias characteristics to be excellent.

PRIOR ART DOCUMENTS

Japanese Patent Laid-Open Publication No. 2002-093623
Japanese Patent Laid-Open Publication No. 2004-342963
Japanese Patent Laid-Open Publication No. 2002-299123

SUMMARY OF THE INVENTION

An aspect of the present invention provides a multi-layered chip electronic component coping with high-current requirements while allowing DC bias characteristics to be excellent even when being miniaturized, by controlling a thickness of a conductive pattern and a thickness of a magnetic layer formed between the conductive patterns.

According to an aspect of the present invention, there is provided a multi-layered chip electronic component, including: a multi-layered body formed to be 2016-sized or smaller and including a plurality of first magnetic layers forming common layers with conductive patterns; and second magnetic layers formed between the conductive patterns adjacent to each other in a stacking direction and including via electrodes electrically connecting the conductive patterns to form coil patterns in a stacking direction, within the multi-layered body, wherein in a cross section cut in width and thickness directions of the multi-layered body, when a thickness of the second magnetic layer is defined as Ts and a thickness of the conductive pattern is defined as Te, $0.1 \leq Ts:Te \leq 0.3$ is satisfied and when a width of the multi-layered body is defined as W and an inner width of the coil pattern is defined as Fw, $0.6 \leq Fw:W \leq 0.8$ is satisfied.

According to another aspect of the present invention, there is provided a multi-layered chip electronic component, including: a multi-layered body including a plurality of first magnetic layers on which conductive patterns are formed; and second magnetic layers interposed between the first magnetic layers within the multi-layered body, wherein the conductive patterns are electrically connected to form coil patterns in a stacking direction, and when a thickness of the second magnetic layer is defined as Ts and a thickness of the conductive pattern is defined as Te, $0.1 \leq Ts:Te \leq 0.3$ is satisfied.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
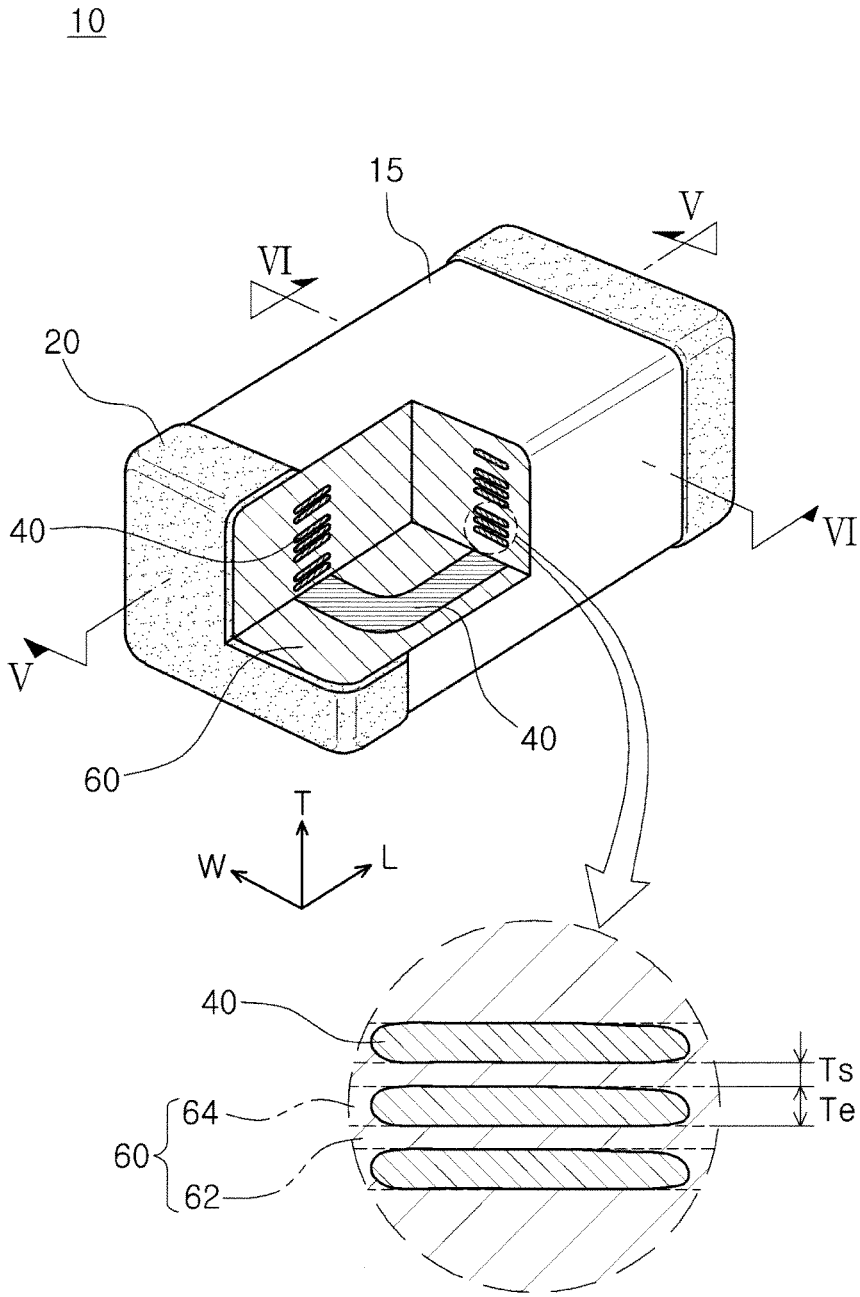
FIG. 1 is a partially cut perspective view of a multi-layered chip inductor according to an embodiment of the present invention.

Embodiments of the present invention will now be described in detail with reference to the accompanying drawings. However, it should be noted that the spirit of the present invention is not limited to the embodiments set forth herein and those skilled in the art and understanding the present invention can easily accomplish retrogressive inventions or other embodiments included in the spirit of the present invention by the addition, modification, and removal of components within the same spirit, but those are to be construed as being included in the spirit of the present invention.

Further, like reference numerals will be used to designate like components having similar functions throughout the drawings within the scope of the present invention.

A multi-layered chip electronic component according to an embodiment of the present invention may be appropriately applied as a chip inductor in which conductive patterns are formed on magnetic layers, chip beads, a chip filter, and the like.

Hereinafter, embodiments of the present invention will be described with reference to a multi-layered chip inductor.

Multi-Layered Chip Inductor

Figure 2A:
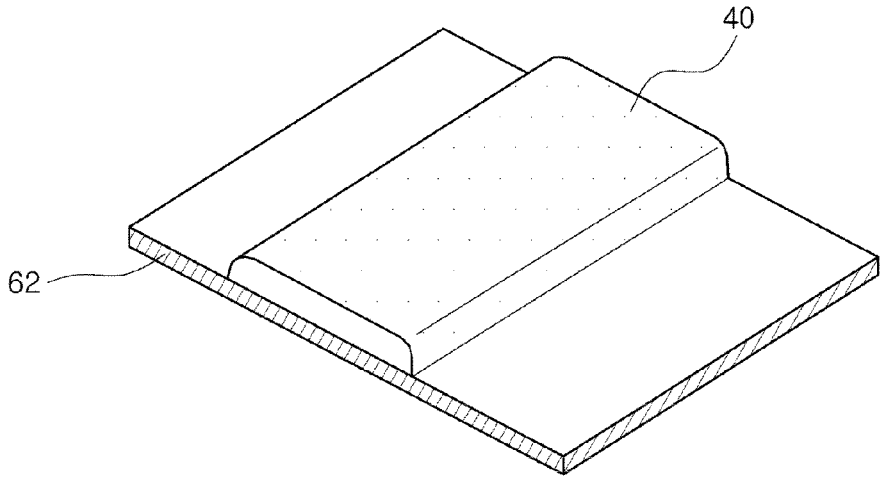
FIGS. 2A through 2C are diagrams illustrating a method in which conductive patterns and magnetic layers of the multi-layered chip inductor of FIG. 1 are multi-layered.
Figure 2B:
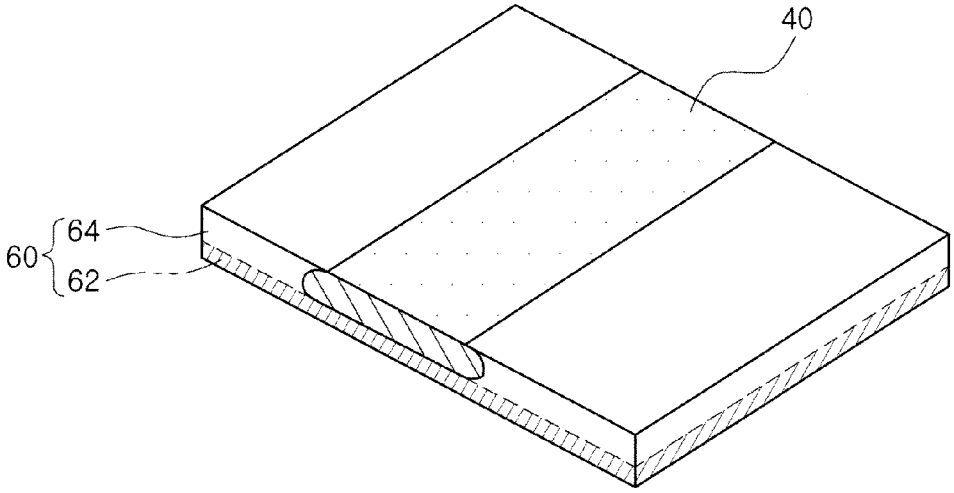
Figure 2C:
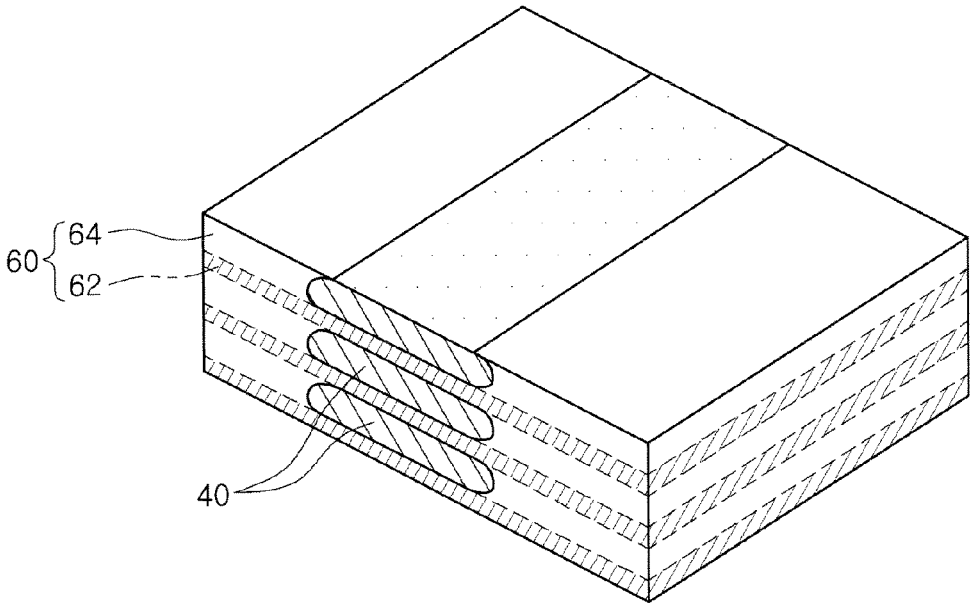
Figure 3:
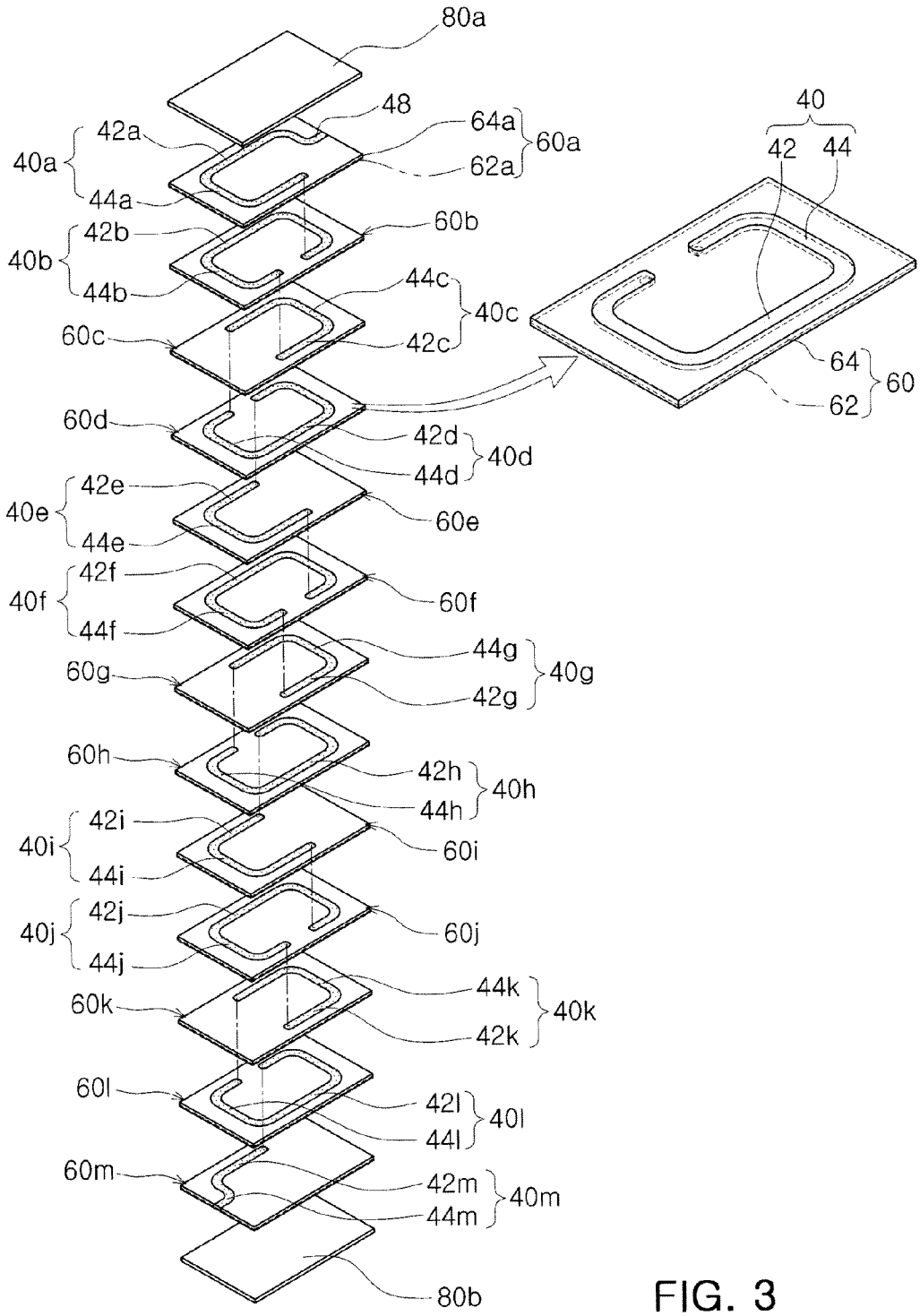
FIG. 3 is a schematic exploded perspective view of a multi-layered appearance of the multi-layered chip inductor of FIG. 1.

FIG. 1 is a partially cut perspective view of a multi-layered chip inductor according to an embodiment of the present invention, FIGS. 2A through 2C are diagrams illustrating a method in which conductive patterns and magnetic layers of the multi-layered chip inductor of FIG. 1 are multi-layered, and FIG. 3 is a schematic exploded perspective view of a multi-layered appearance of the multi-layered chip inductor of FIG. 1.

Figure 4:
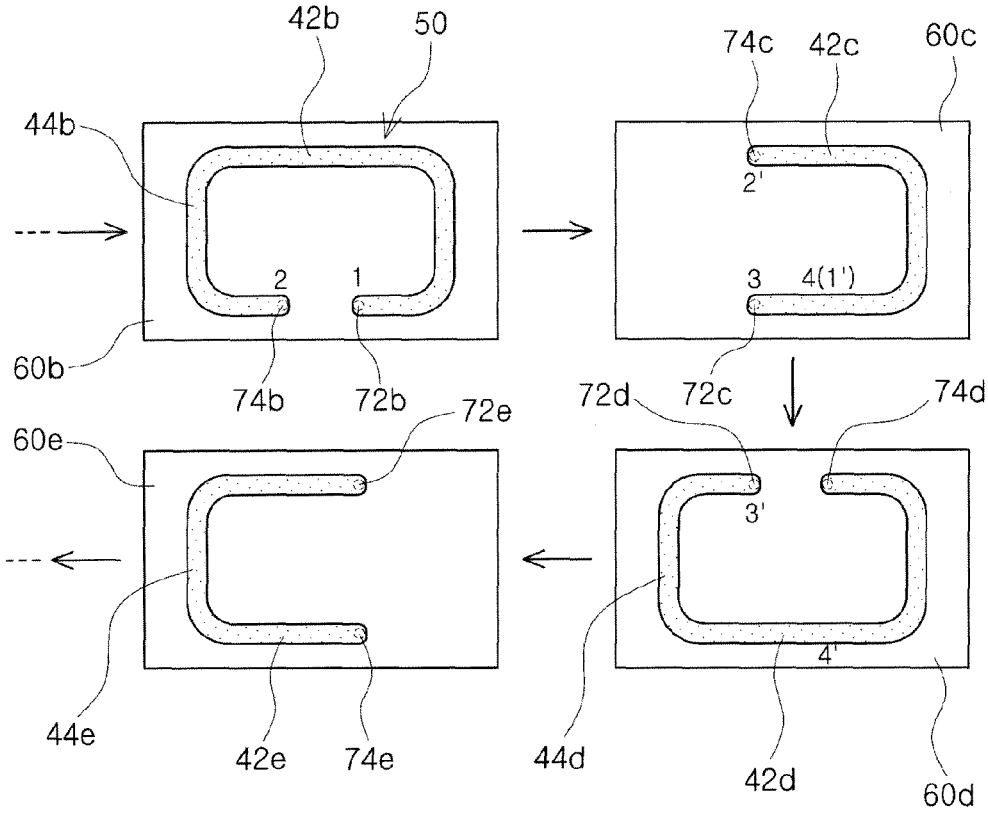
FIG. 4 is a schematic plan view showing an appearance of conductive patterns formed on the magnetic layers of FIG. 1.

In addition, FIG. 4 is a schematic plan view showing an appearance of conductive patterns formed on the magnetic layers of FIG. 1.

Referring to FIGS. 1 to 4, a multi-layered chip inductor 10 may include a multi-layered body 15, conductive patterns 40, magnetic layers 62 and 64, and external electrodes 20.

The multi-layered body 15 may be manufactured by printing the conductive patterns 40 on magnetic green sheets and multi-layering and sintering the magnetic green sheet on which the conductive patterns 40 are formed.

The multi-layered body 15 may have a hexahedral shape. When the magnetic green sheets are multi-layered and sintered in a chip shape, the multi-layered body 15 may not be formed to have a hexahedral shape having completely straight lines, due to a sintering shrinkage of ceramic powder particles. However, the multi-layered body 15 may be formed to have a substantially hexahedral shape.

When defining a hexahedral direction in order to clearly describe embodiments of the present invention, L, W, and T in FIG. 1 each represent a length direction, a width direction, and a thickness direction. Here, the thickness direction may be used as to have the same concept as a direction in which magnetic layers are multi-layered.

An embodiment of FIG. 1 shows the chip inductor 10 having a rectangular parallelepiped shape.

Here, as shown in FIG. 2, in the present embodiment the conductive patterns 40 may be printed on the magnetic green sheets and then, a magnetic substance having a thickness equal to that of the conductive pattern 40 may be applied thereto or printed thereon. That is, after the magnetic substance is sintered, separate magnetic layers differentiated from the magnetic green sheets may be formed therewith. After being sintered, the magnetic layer forming the common layer with the conductive pattern 40 may be defined as a first magnetic layer 64 and the sintered magnetic green sheet interposed between the first magnetic layers 64 within the multi-layered body 15 may be defined as a second magnetic layer 62.

A plurality of first and second magnetic layers 64 and 62 configuring the multi-layered body 15 are in a sintered state, and the adjacent first and second magnetic layers 64 and 62 may be integrated such that a boundary therebetween may not be readily apparent without using a scanning electron microscope (SEM).

Meanwhile, the multi-layered chip inductor 10 according to the embodiment of the present invention may have a size in which a length and a width each having a range of 2.0±0.1 mm and 1.6±0.1 mm (2016-sized), including the external electrodes 20, and may be formed to be 2016-sized or smaller (that is, a length of the multi-layered body may be 2.1 mm or less and a width of the multi-layered body may be 1.7 mm or less).

The first and second magnetic layers 64 and 62 are formed of a Ni—Cu—Zn-based substance, a Ni—Cu—Zn—Mg-based substance, a Mn—Zn-based substance, a ferrite-based substance, or the like, but the embodiment of the present invention is not limited to these substances.

Referring to FIGS. 2A through 2C, the conductive pattern 40 is printed on the ferrite green sheet 62 and dried (FIG. 2A) and a separate planarized magnetic layer 64 differentiated from the ferrite green sheet 62 is formed by printing a ferrite slurry as a paste in a space adjacent to the conductive pattern 40 so as to form a common layer with the conductive pattern 40. The ferrite green sheet 62 and the magnetic layer 64 planarized with the conductive pattern 40 form a single multi-layered carrier 60 (FIG. 2B). In addition, the multi-layered carrier 60 may be multi-layered in plural so that the conductive patterns 40 form coil patterns 50 in a stacking direction (FIG. 2C).

The conductive patterns 40 may be formed by printing a conductive paste using silver (Ag) as a main component to have a predetermined thickness. The conductive patterns 40 may be electrically connected to the external electrodes 20 that are formed at both longitudinal ends.

The external electrodes 20 are formed at both longitudinal ends of the ceramic body 15 and may be formed by electroplating an alloy selected from Cu, Ni, Sn, Ag, and Pd. However, the embodiment of the present invention is not limited to these substances.

The conductive patterns 40 may include leads that are electrically connected to the external electrodes 20.

Referring to FIG. 3, a conductive pattern 40*a* on a single multi-layered carrier 60*a* includes a conductive pattern 42*a* formed in a length direction and a conductive pattern 44*a* formed in a width direction. The conductive pattern 40*a* is electrically connected to a conductive pattern 40*b* on another multi-layered carrier 60*b* having a magnetic layer 62*a* disposed therebetween through via electrodes 72 and 74 formed on the magnetic layer 62*a* to form the coil patterns 50 in a stacking direction.

All of the coil patterns 50 according to the embodiment of the present invention have a turns amount of 9.5 times, but the embodiment of the present invention is not limited thereto. In order for the coil patterns 50 to have a turns amount of 9.5 times, thirteen multi-layered carriers 60*a*, 60*b*, . . . , 60*m* in which conductive patterns 40*a*, 40*b*, . . . , 40*m* are formed are disposed between top and bottom magnetic layers 80*a* and 80*b* forming a cover layer.

The embodiment of the present invention discloses the conductive patterns 42*a* and 44*b* requiring two multi-layered carriers so as to form the coil patterns 50 having a turns amount of one time, but is not limited thereto and therefore, may require a different amount of multi-layered carriers according to a shape of the conductive pattern.

Here, DC bias characteristics may be excellent within the limited multi-layered body 15 by reducing an interval between the magnetic layers between the upper conductive pattern 40*a* and the lower conductive pattern 40*b* that face each other in the stacking direction, having the magnetic layers 62*a* therebetween. When the interval between the magnetic layers can be reduced, the thickness of the conductive patterns 42*a* and 44*a* is increased, and thus, resistance to current flowing in a coil may be reduced.

Describing a one-time turn amount of the coil patterns 50 with reference to FIG. 4, when a single via electrode 72*b* is defined as 1 and another via electrode 74*b* is defined as 2 in the conductive pattern 40*b* formed on the same magnetic layer 60*b*, a via electrode 72*c* of the conductive pattern 40*c* under the stacking direction corresponding to the 2 is defined as 3, and an opposite point of the conductive pattern 42*c* of the magnetic layer 60*c* facing the 1 is defined as 4, a one-time turn (1→2→3→4) is formed counterclockwise from 1, which may be defined as one turn. When 4 is defined as 1', the next one-time turn (1'→2'→3'→4') may be formed.

Figure 5:
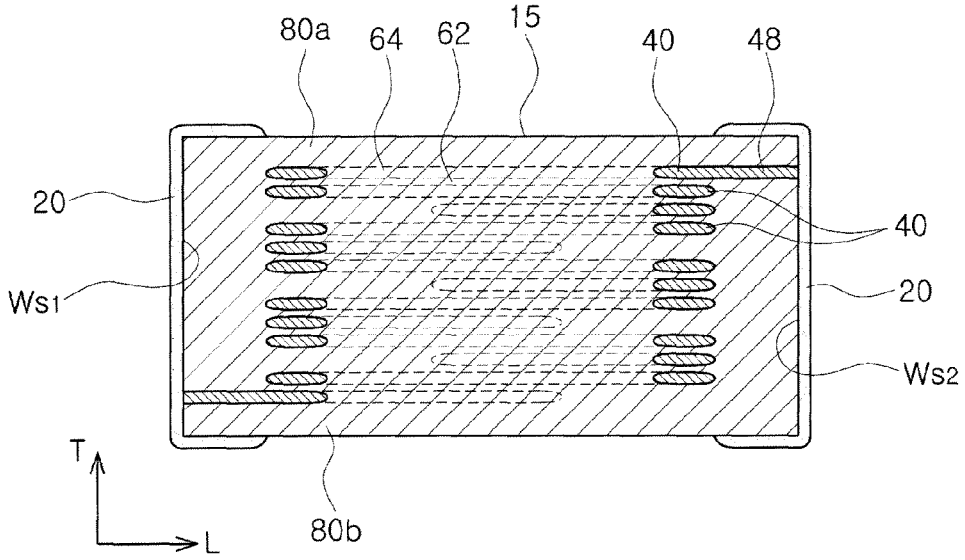
FIG. 5 is a schematic cross-sectional view taken along line V-V' of FIG. 1.
Figure 6:
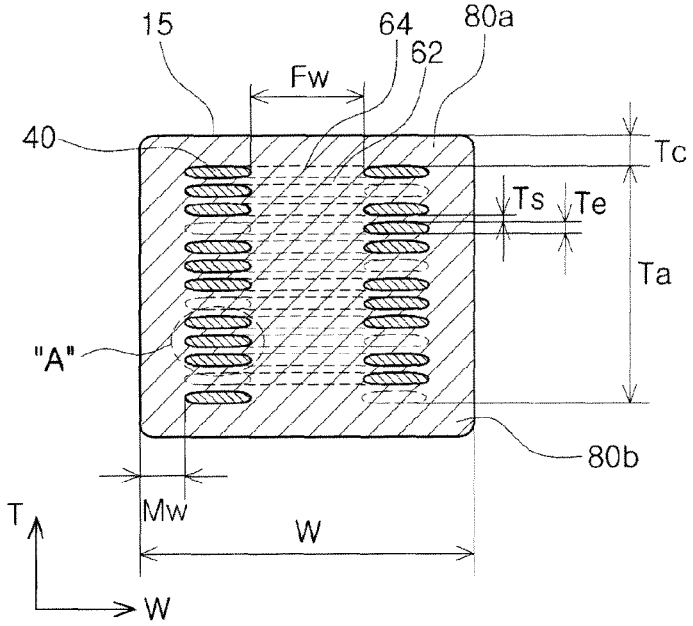
FIG. 6 is a schematic cross-sectional view taken along line VI-VI' of FIG. 1.

FIG. 5 is a schematic cross-sectional view taken along line V-V' of FIG. 1 and FIG. 6 is a schematic cross-sectional view taken along line VI-VI' of FIG. 1.

FIG. 5 shows that the multi-layered chip inductor of FIG. 1 is cut in a length direction L and a thickness direction T, and FIG. 6 shows that the multi-layered chip inductor of FIG. 1 is cut in a width direction W and a thickness direction T.

In the cross-sectional views of FIGS. 5 and 6, on the assumption that the dotted line portion indicates that the conductive patterns 40 are formed, it describes a dimension relationship such as a thickness between the conductive patterns 40 and the magnetic layers 60, and the like.

As shown in FIG. 5, when being viewed in the length direction L and the thickness direction T, leads 48 that are electrically connected to the external electrodes 20 are formed on top and bottom magnetic layers on which the conductive patterns 40 are formed. The leads 48 are exposed to short sides Ws1 and Ws2 in a length direction of the ceramic body 15 and are electrically connected to the external electrodes 20.

The conductive patterns 40 form a common layer with the first magnetic layers 64 and may be disposed to face each other within the multi-layered body 15, having the second magnetic layer 62 therebetween.

Here, the first magnetic layers 64 may be printed to have a thickness equal to that of the conductive pattern 40.

In the embodiment of the present invention, when the thickness of the second magnetic layer 62 is defined as Ts and the thickness of the conductive pattern 40 is defined as Te, the thickness of the second magnetic layer 62 may be lower than that of the conductive pattern 40.

The following Table 1 represents experimental results for each chip size regarding an effect of a ratio Ts:Te of the thickness Ts of the second magnetic layer to the thickness Te of the conductive pattern on DC resistance Rdc of the multi-layered chip inductor and a magnitude in allowable current, when the thickness of the second magnetic layer is defined as Ts and the thickness of the conductive pattern is defined as Te in a cross section in the width and thickness directions.

DC resistance was measured using an Agilent 4338B model milliohm meter and allowable current was measured by a DC bias current value in which an L value was reduced to 300 or less of an initial value in the state in which the DC bias current was applied.

TABLE 1

| Sample NO. | Size | Ts (μm) | Te (μm) | Ts:Te | Rdc (mΩ) | Allowable Current (mA) |
|---|---|---|---|---|---|---|
| 101 | 3216 | 11.5 | 33.4 | 0.34 | 97 | 276 |
| 102 | 2520 | 13.8 | 34.3 | 0.40 | 96 | 298 |
| 103 | 2016 | 11.2 | 31.3 | 0.36 | 134 | 192 |
| 104 | 2012 | 8.49 | 23.6 | 0.36 | 152 | 185 |
| 105 | 1608 | 5.62 | 14.9 | 0.38 | 166 | 181 |
| 106 | 1005 | 3.43 | 9.71 | 0.35 | 175 | 179 |
| 107 | 0603 | 2.15 | 5.87 | 0.37 | 181 | 173 |

As shown in Table 1, in a case of the chip exceeding 2016 size, since the inner space of the chip was relatively large, the DC resistance Rdc was less than 100 mΩ and the allowable current value had a value larger than 250 mA even when the Ts:Te value exceeded 0.3.

However, when the Ts:Te value exceeded 0.3 in a of 2016-sized chip or smaller, since the inner space of the chip was relatively small, it could be appreciated that the DC resistance Rdc was high due to the relatively small electrode area and the fact that the allowable current value also had a small value of less than 200 mA.

Therefore, in the case of a 2016-sized chip or smaller, there is a need to adjust the Ts:Te value as in the embodiment of the present invention, in order to lower the DC resistance Rdc and increase the allowable current value while securing sufficient inductance capacity.

According to the embodiment of the present invention, Ts:Te may satisfy a range of $0.1 \leq Ts:Te \leq 0.3$. When Ts:Te is less than 0.1, a short has occurred and a defect has occurred accordingly, while when Ts:Te exceeds 0.3, a cross sectional area of the conductive pattern 40 is reduced and the DC resistance Rdc of the coil is increased accordingly, such that it may be difficult to apply a relatively high DC current to an inductor.

Here, since the thickness of the second magnetic layer 62 and the thickness of the conductive pattern 40 may not be perfectly the same for respective layers due to sintering, the thickness Ts of the conductive pattern 40 and the thickness of the second magnetic layer 62 may each refer to an average thickness.

As shown in FIG. 6, the thickness of the second magnetic layer 62 may be measured with images obtained by scanning the cross section in the width and thickness direction of the multi-layered body 15 using the scanning electron microscope (SEM). For example, for any image of a multi-layered body 15 obtained by scanning the cross section in the width and thickness direction W-T cut at the central portion in the length direction L of the multi-layered body 15 using the SEM, the thickness of the second magnetic layer 62 between the conductive patterns 40 may be extracted from the image by measuring thicknesses at five points in the width direction having equal intervals therebetween, and thus, an average thickness value may be obtained. The thickness of the conductive pattern 40 may be measured at five points in the width direction equal intervals therebetween, and thus, the average value thereof may be obtained.

When the average value is measured by expanding the average value measurement to at least three second magnetic layers 62 and conductive patterns 40, the thickness of the second magnetic layer 62 and the thickness of the conductive pattern 40 may be further generalized.

In addition, as shown in FIG. 5, the thickness of the second magnetic layer 62 and the thickness of the conductive pattern 40 may be measured even by the images obtained by scanning the cross section taken in the length and thickness directions L-T at the central portion of the multi-layered body 15 in the width direction W thereof, using the SEM.

Here, the central portion of the width direction W or the length direction L of the multi-layered body 15 may be defined as a point within a range of 30% of the width or the length of the multi-layered body 15 from the center point of the width direction W or the length direction L of the multi-layered body 15.

In the cross section cut in the width and thickness direction of the multi-layered body as shown in FIG. 6, a thickness Ta of an active region layer defined by forming the conductive patterns 40 in the stacking direction and a thickness Tc of each of the cover layers 80*a* and 80*b* multi-layered over or under the top or bottom conductive pattern 40 may be measured by the same method.

According to the embodiment of the present invention, Tc:Ta may satisfy a range of $0.1 \leq Tc:Ta \leq 0.5$. When Tc:Ta is less than 0.1, no cover layer 80*a* is present. Therefore, DC bias characteristics are reduced due to magnetic saturation and defects occur due to surface cracks. In addition, it is not easy to implement the inductance capacity.

Further, when the Tc:Ta exceeds 0.5, the cover layer 80*a* is multi-layered and thus, is thick, from which it may be difficult to implement miniaturization. Further, in order to secure the same turns amount, there is a need to reduce the thickness of the conductive pattern. As a result, the DC resistance Rdc of the coil is increased, such that it may be difficult to apply relatively high DC current to the inductor.

According to another embodiment of the present invention, when the width of the multi-layered body 15 is defined as W and the inner width of the coil pattern 50 is defined as Fw in the cross section cut in the width and thickness direction of the multi-layered body, Fw:W may satisfy 0.6≤Fw: W≤0.8.

When Fw:W is less than 0.6, the length of the conductive pattern 40 is reduced and the capacity thereof is reduced accordingly, while when Fw:W exceeds 0.8, a phenomenon in which the conductive patterns 40 are exposed to one surface of the multi-layered body 15 due to the cutting deviation during the manufacturing process may occur and the risk of delamination may be increased.

According to the embodiment of the present invention, when the width of the multi-layered body 15 is defined as W in the cross section cut in the width and thickness direction of the multi-layered body and the width of the margin formed at the edge of the width direction of the multi-layered body 15 in the conductive pattern 40 is defined as Mw, Mw:W may satisfy 0.05≤Mw:W≤0.1.

When Mw:W is less than 0.05, a phenomenon in which the conductive patterns 40 are exposed to one surface of the multi-layered body 15 may occur and the risk of delamination may be increased. In addition, when Mw:W exceeds 0.1, the cross sectional area of the conductive pattern 40 is reduced and therefore, the DC resistance Rdc of the coil is increased, such that it may be difficult to apply the relatively high DC current to the inductor.

Figure 7:
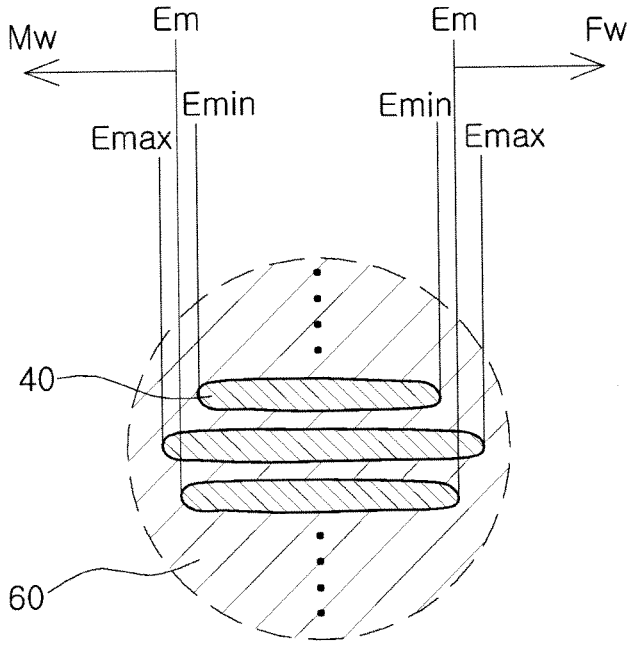
FIG. 7 is an enlarged view of A of FIG. 6 for illustrating dimensions of an inner width Fw of a coil pattern and a width Mw of a margin.

The multi-layered chip inductor 10 is subjected to compression and sintering processes and therefore, ends of the conductive patterns may be deformed or offset to a wedge shape as shown in FIG. 7 when the cross section cut as shown in FIGS. 5 and 6 is scanned by the SEM.

A method of measuring the inner width Fw of the coil pattern 50 formed in the conductive pattern 40 and the width Mw of the margin formed at the edge of the width direction of the multi-layered body 15 from the conductive pattern 40 will be described with reference to FIG. 7.

FIG. 7 is an enlarged view of A of FIG. 6 for illustrating dimensions of an inner width Fw of a coil pattern and a width Mw of a margin.

Referring to FIG. 7, the Fw and Mw may be measured by using as a boundary an intermediate value Em with respect to an extension line Emax extending in the stacking direction from a portion that has the largest offset deformation among the ends of the conductive patterns 40 and an extension line Emin extending in the stacking direction from a portion that has the smallest offset deformation among the ends of the conductive patterns 40.

The Fw is a value obtained by measuring the length to the Em of the conductive pattern 40 of the same layer based on the Em, and the Mw is a value obtained by measuring the length to one surface of the width direction of the multi-layered body 15 based on the Em.

Thus, a multi-layered chip electronic component capable of appropriately coping with the high-current requirement while allowing DC bias characteristics to be excellent, by reducing the interval between the magnetic substances between the upper conductive pattern 40*a* and the lower conductive pattern 40*b* that face each other in the stacking direction, having the magnetic layer 62*a* therebetween, may be provided.

EXPERIMENTAL EXAMPLE

The multi-layered chip inductor, according to the Inventive Examples of the present invention and Comparative Examples thereof, was manufactured as follows. A plurality of magnetic green sheets manufactured by applying a slurry including the Ni—Zu—Cu-based ferrite powder on a carrier film and drying the slurry are prepared.

Next, the conductive patterns are formed by applying a silver (Ag) conductive paste to the magnetic green sheet using a screen. In addition, the single multi-layered carrier may be formed together with the magnetic green sheet by applying the ferrite slurry to the magnetic green sheet around the conductive pattern so as to form a common layer with the conductive pattern.

The multi-layered carriers in which the conductive patterns are formed are repeatedly multi-layered and the conductive patterns are electrically connected, thereby forming the coil pattern in the stacking direction. Here, the via electrodes are formed on the magnetic green sheet to electrically connect upper conductive patterns with lower conductive patterns, having the magnetic green sheet therebetween.

Here, the multi-layered carriers are stacked within a range of 10 layers to 20 layers, together with the top and bottom cover layers, which were isostatically pressed under pressure conditions of 1000 kgf/cm$^2$ at 85° C. The pressed chip laminate was cut in the form of individual chips, and the cut chips were subjected to a debinder process by being maintained at 230° C. for 40 hours under an air atmosphere.

Next, the chip laminate was fired under an air atmosphere at a temperature of 950° C. or less. In this case, the size of the fired chip was 2.0 mm×1.6 mm (L×W), 2016-sized.

Next, the external electrodes were formed by processes, such as the applying of external electrodes, electrode firing, plating, and the like.

Here, samples of the multi-layered chip inductor were manufactured so that the thickness Te of the conductive pattern, the thickness Ts of the second magnetic layer, the thickness Ta of the active layer, the thickness Tc of the cover layer, the inner width Fw of the conductive pattern within the same layer, the width Mw of the margin formed in the width direction at the edge of the multi-layered body from the conductive pattern are variously provided in the cross section in the width and thickness direction W-T.

Te, Ts, Ta, Tc, Fw, and Mw were measured by capturing a high magnification image of the cut cross section obtained by polishing the central portion of the multi-layered body 15 using an optical microscope and analyzing the captured high magnification image using a computer programs such as a SigmaScan Pro, or the like.

Hereinafter, the embodiments of the present invention will be described in more detail with reference to the experimental data of the Inventive Examples of the present invention and the Comparative Examples.

The following Table 2 shows results obtained by measuring the occurrence frequency of short and the change in the DC resistance and the allowable current according to the change in Ts:Te, in a cross section cut in the width and thickness direction.

TABLE 2

| Sample NO. | Ts (μm) | Te (μm) | Ts:Te | Short Occurrence (%) | Rdc (mΩ) | Allowable Current (mA) |
|---|---|---|---|---|---|---|
| 1* | 2 | 41 | 0.05 | 93 | — | — |
| 2* | 3.6 | 39.7 | 0.09 | 57 | — | — |
| 3 | 4.4 | 38.9 | 0.11 | 1 | 102.2 | 273 |
| 4 | 5.4 | 38.1 | 0.14 | 0 | 103.3 | 280 |
| 5 | 7.6 | 35.8 | 0.21 | 0 | 112.2 | 271 |
| 6 | 9.9 | 33.5 | 0.30 | 0 | 124.7 | 253 |
| 7* | 11.6 | 31.7 | 0.37 | 0 | 138.0 | 190 |

*Comparative Example

Here, short occurrence was determined by measuring inductance L and Q factor, wherein the L and Q were measured using an LCR meter of the Agilent 4286A model. Here, the case in which the measured L and Q value were measured at 50% or less to an average was considered to be a short occurrence.

DC resistance was measured using an Agilent 4338B model milliohm meter and the allowable current was measured by a DC bias current value in which an L value is reduced to 30% or less of an initial value in the state in which the DC bias current is applied.

Referring to Table 2, in case of samples 1 and 2 in which Ts:Te was less than 0.1, a short occurred, while in the case of sample 7 in which Ts:Te exceeded 0.3, the DC resistance Rdc of the coil was increased, such that it may be difficult to apply the high DC current.

It could be appreciated that in samples 3 to 6 that are the Inventive Examples of the present invention, the DC resistance is not large and the allowable current is increased and thus, DC bias characteristics are improved.

The following Table 3 shows results obtained by measuring the change in the measured inductance to the targeted inductance, the delamination, the DC resistance, and the allowable current, according to Ts:Te, Fw:W, Mw:W, and Tc:Ta values in a cross section cut in the width and thickness directions.

The inductance and the allowable current were measured using an Agilent 4286A model LCR meter and the DC resistance Rdc was measured using an Agilent 4338B model milliohm meter, as described above.

It can be appreciated from Table 3 that in the case of sample 8 in which Fw:W was less than 0.6, the inductance was relatively small and in case of samples 13 and 14 in which Fw:W exceeded 0.8, the number of samples in which the delamination phenomenon occurs was indicated. It could be appreciated that in samples 9 to 12, Inventive Examples of the present invention, the DC resistance was not large and the allowable current was increased and thus, DC bias characteristics were improved.

In addition, in case of sample 15 in which the Mw:W was less than 0.05, the occurrence rate of delamination was considerably increased and in the case of sample 21 in which Mw:W exceeded 0.1, the DC resistance Rdc of the coil was increased, such that it was difficult to apply relatively high DC current to the inductor. It could be appreciated that in samples 16 to 20, Inventive Examples of the present invention, the DC resistance was not large and the allowable current was increased and thus, DC bias characteristics were improved.

Further, in the case of sample 22 in which Tc:Ta was less than 0.1, defects occurred due to surface cracks in the cover layer. In addition, it could be appreciated that when the cover layer was thin, an area through which a magnetic flux could pass was reduced, and as a result, it was difficult to form a large amount of magnetic flux and the capacity value of the inductance capacity was reduced. In addition, the magnetic saturation rapidly appears in the cover layer and thus, the allowable current value is reduced. Further, in a case of sample 28 in which Tc:Ta exceeded 0.5, since the cover layer 80*a* was multi-layered and was thus thick and the coil pattern of a turns amount defined in the narrow active layer for inductance implementation was formed, the thickness of the coil pattern was low, the DC resistance Rdc was increased, and miniaturization was difficult to implement.

TABLE 3

| Sample No. | Ts:Te | Fw:W | Mw:W | Tc:Ta | Inductance (to Targeted Capacity) (%) | Delamination Occurrence (%) | Rdc (mΩ) | Allowable Current (mA) |
|---|---|---|---|---|---|---|---|---|
| 8* | 0.21 | 0.54 | 0.07 | 0.3 | 77 | 0 | 78.3 | — |
| 9 | 0.21 | 0.61 | 0.07 | 0.3 | 90 | 0 | 90.3 | — |
| 10 | 0.21 | 0.65 | 0.07 | 0.3 | 95 | 0 | 101.3 | — |
| 11 | 0.21 | 0.72 | 0.07 | 0.3 | 101 | 0 | 112.2 | — |
| 12 | 0.21 | 0.78 | 0.07 | 0.3 | 112 | 0 | 125.2 | — |
| 13* | 0.21 | 0.81 | 0.07 | 0.3 | 110 | 2 | 132.5 | — |
| 14* | 0.21 | 0.83 | 0.07 | 0.3 | 105 | 25 | 143.6 | — |
| 15* | 0.21 | 0.72 | 0.03 | 0.3 | 76 | 56 | 74.8 | — |
| 16 | 0.21 | 0.72 | 0.05 | 0.3 | 92 | 1 | 89.8 | — |
| 17 | 0.21 | 0.72 | 0.07 | 0.3 | 101 | 0 | 112.2 | — |
| 18 | 0.21 | 0.72 | 0.08 | 0.3 | 105 | 0 | 119.3 | — |
| 19 | 0.21 | 0.72 | 0.09 | 0.3 | 111 | 0 | 127.2 | — |
| 20 | 0.21 | 0.72 | 0.10 | 0.3 | 113 | 0 | 132.8 | — |
| 21* | 0.21 | 0.72 | 0.12 | 0.3 | 114 | 0 | 209.4 | — |
| 22* | 0.21 | 0.72 | 0.07 | 0.05 | 71 | 37 | 112.2 | 198 |
| 23 | 0.21 | 0.72 | 0.07 | 0.12 | 83 | 0 | 110.5 | 253 |
| 24 | 0.21 | 0.72 | 0.07 | 0.3 | 101 | 0 | 112.2 | 271 |
| 25 | 0.21 | 0.72 | 0.07 | 0.38 | 109 | 0 | 119.8 | 280 |
| 26 | 0.21 | 0.72 | 0.07 | 0.45 | 115 | 0 | 125.6 | 273 |
| 27 | 0.21 | 0.72 | 0.07 | 0.49 | 120 | 0 | 131.1 | 276 |
| 28* | 0.21 | 0.72 | 0.07 | 0.55 | 130 | 0 | 145.8 | 272 |

*Comparative Example

It could be appreciated that in samples 23 to 27, Inventive Examples of the present invention, the DC resistance is not large and the allowable current is increased and thus, DC bias characteristics are improved.

As set forth above, the multi-layered chip electronic component according to the embodiments of the present invention may be suitable for the high-current trend of the set while allowing DC bias characteristics to be excellent, even when being miniaturized.

While the present invention has been shown and described in connection with the embodiments, it will be apparent to those skilled in the art that modifications and variations can be made without departing from the spirit and scope of the invention as defined by the appended claims.

What is claimed is:

1. A multi-layered chip electronic component, comprising:

a multi-layered body including a plurality of first magnetic layers forming common layers with conductive patterns, wherein a length of the multi-layered body is 2.1 mm or less and a width of the multi-layered body is 1.7 mm or less; and second magnetic layers formed between the conductive patterns adjacent to each other in a stacking direction and including via electrodes electrically connecting the conductive patterns to form coil patterns in a stacking direction, within the multi-layered body, in a cross section cut in width and thickness directions of the multi-layered body, when a thickness of the second magnetic layer is defined as Ts and a thickness of the conductive pattern is defined as Te, $0.1 \leq Ts:Te \leq 0.3$ being satisfied, and when a width of the multi-layered body is defined as W and an inner width of the coil pattern is defined as Fw, $0.6 \leq Fw:W \leq 0.8$ being satisfied.

2. The multi-layered chip electronic component of claim 1, wherein in the cross section cut in the width and thickness directions of the multi-layered body, when a thickness of an active region layer defined by forming the conductive patterns in the stacking direction is defined as Ta and a thickness of a cover layer multi-layered over or under a top or bottom conductive pattern is defined as Tc, $0.1 \leq Tc:Ta \leq 0.5$ is satisfied.

3. The multi-layered chip electronic component of claim 1, wherein in the cross section cut in the width and thickness directions of the multi-layered body, when the width of the multi-layered body is defined as W and a width of a margin formed at an edge of a width direction of the multi-layered body from the conductive pattern is defined Mw, $0.05 \leq Mw:W \leq 0.1$ is satisfied.

4. The multi-layered chip electronic component of claim 1, wherein the first magnetic layer is printed to correspond to the thickness of the conductive pattern.

5. The multi-layered chip electronic component of claim 1, wherein a length and a width of the multi-layered chip electronic component have a range of 2.0±0.1 mm and 1.6±0.1 mm.

6. A multi-layered chip electronic component, comprising:

a multi-layered body including a plurality of first magnetic layers on which conductive patterns are formed, wherein a length of the multi-layered body is 2.1 mm or less and a width of the multi-layered body is 1.7 mm or less; and second magnetic layers interposed between the first magnetic layers within the multi-layered body, the conductive patterns being electrically connected to form coil patterns in a stacking direction, and when a thickness of the second magnetic layer is defined as Ts and a thickness of the conductive pattern is defined as Te, $0.1 \leq Ts:Te \leq 0.3$ being satisfied.

7. The multi-layered chip electronic component of claim 6, wherein in the cross section cut in the width and thickness directions of the multi-layered body, when a thickness of an active region layer defined by forming the conductive patterns in the stacking direction is defined as Ta and a thickness of a cover layer multi-layered over or under a top or bottom conductive pattern is defined as Tc, $0.1 \leq Tc:Ta \leq 0.5$ is satisfied.

8. The multi-layered chip electronic component of claim 6, wherein in the cross section cut in the width and thickness directions of the multi-layered body, when the width of the multi-layered body is defined as W and an inner width of the coil pattern is defined as Fw, $0.6 \leq Fw:W \leq 0.8$ is satisfied.

9. The multi-layered chip electronic component of claim 6, wherein in the cross section cut in the width and thickness directions of the multi-layered body, when the width of the multi-layered body is defined as W and a width of a margin formed at an edge of a width direction of the multi-layered body from the conductive pattern is defined as Mw, $0.05 \leq Mw:W \leq 0.1$ is satisfied.

10. The multi-layered chip electronic component of claim 6, wherein the first magnetic layer is printed to correspond to the thickness of the conductive pattern that is printed on the second magnetic layer.

11. The multi-layered chip electronic component of claim 6, wherein a length and a width of the multi-layered chip electronic component have a range of 2.0±0.1 mm and 1.6±0.1 mm.

* * * * *